US005807227A

United States Patent [19]

Field

[11] Patent Number: 5,807,227

[45] Date of Patent: Sep. 15, 1998

[54] FOLD-OFF GUIDING METHOD AND DEVICE FOR A FOLDING APPARATUS

[75] Inventor: David George Field, Dover, N.H.

[73] Assignees: Heidelberg Harris Inc., Dover, N.H.; Heidelberger Druckmaschinen AG, Heidelberg, Germany

[21] Appl. No.: 909,160

[22] Filed: Aug. 11, 1997

Related U.S. Application Data

[63] Continuation of Ser. No. 629,627, Apr. 9, 1996, abandoned.

[51] Int. Cl.[6] ..... B65H 45/12

[52] U.S. Cl. ..... 493/424; 493/432; 493/357

[58] Field of Search ..... 493/425–429, 493/431, 432, 358, 357; 271/275, 277, 314; 270/6, 8, 9, 20.1, 21.1, 49, 50

[56] References Cited

U.S. PATENT DOCUMENTS

| | | | |
|---|---|---|---|
| 3,758,102 | 9/1973 | Munn et al. | 493/342 |
| 4,123,048 | 10/1978 | Weschenfelder et al. | 493/431 |
| 4,344,610 | 8/1982 | Jeschke et al. | 270/6 |
| 4,465,269 | 8/1984 | Petersen | 493/425 |
| 4,494,949 | 1/1985 | Baley . | |
| 4,521,007 | 6/1985 | Darda | 270/47 |
| 4,627,609 | 12/1986 | Höfer | 271/314 |
| 4,629,175 | 12/1986 | Fischer | 271/202 |
| 4,697,805 | 10/1987 | Herb | 270/47 |
| 4,817,932 | 4/1989 | Stäb et al. | 270/47 |
| 5,013,020 | 5/1991 | Stoll . | |
| 5,226,871 | 7/1993 | Skipor | 270/49 |
| 5,236,188 | 8/1993 | Breton | 271/187 |
| 5,390,905 | 2/1995 | Melchior | 270/21.1 |
| 5,411,245 | 5/1995 | Springer et al. | 270/20.1 |
| 5,466,212 | 11/1995 | Springer et al. | 493/434 |
| 5,551,678 | 9/1996 | Michalik et al. | 493/426 |

FOREIGN PATENT DOCUMENTS 0 220 644A2 5/1987 European Pat. Off. .

*Primary Examiner*—Jack W. Lavinder

*Attorney, Agent, or Firm*—Burns, Doane, Swecker & Mathis, LLP

[57] ABSTRACT

The present invention relates to a folder apparatus including a first cylinder for transporting a product and a folding cylinder rotatably engaged with the first cylinder at a nip. A product guiding device is assigned to a transition area between surfaces of the first cylinder and the folding cylinder, the guiding device having a smoothing element which includes different sections of product contacting elements being angled in opposite directions.

20 Claims, 5 Drawing Sheets

FOLD-OFF GUIDING METHOD AND DEVICE FOR A FOLDING APPARATUS

This application is a continuation of application Ser. No. 08/629,627, filed Apr. 9, 1996 now abandoned.

BACKGROUND OF THE INVENTION

1. Field of the Invention

This invention relates to a fold-off guiding device of a folding apparatus, assigned to a rotary printing press and, in particular, to a fold-off device assigned to a transfer area between two sample conducting cylinders.

2. State of the Art

U.S. Pat. No. 4,521,007 discloses braking brushes in a folding apparatus of a rotary printing machines. Braking brushes are arranged for stretching web sections which are conveyed in a given direction on a folding cylinder of the folding apparatus. The braking brushes are individually disposed so as to match the curvature of the cylinder and are distributed over the length of the cylinder, including a spindle and a cross bar both spaced from one another and extending transversely to the given direction in which the web sections are being conveyed. The braking brushes are fastened articulatingly at lower ends thereof to the spindle and at upper ends thereof to the cross bar, and respective levers support the cross bar at each end thereof. The cross bar is independently adjustable by the respective levers for pressing the braking brushes to a greater and lesser extent selectively against the web sections being conveyed on the cylinder.

U.S. Pat. No. 4,494,949 discloses a sheet folding apparatus and method. A sheet or signature is passed edgewise along an arcuate path, a portion of the sheet or signature intermediate the leading and trailing edges thereof is gripped and withdrawn from the first arcuate path to a tangential arcuate path. A fluid or air stream is directed counter to and away from the second path to smoothly guide and gently fold the leading edge back upon the trailing edge.

U.S. Pat. No. 5,013,020 discloses an apparatus to guide copy segments in the folder of rotary printing presses. A moving conveyor is employed in conjunction with a rotating folding flap cylinder to fold and move a copy segment through the printing press. A suction apparatus is provided to remove the copy segment from a folding blade cylinder so that it may be directed to the folding apparatus.

In the technical field, there have been encountered difficulties with respect to the product exchange of folded products in the fold-off area between two product conducting cylinders. In the fold-off area, the product is typically changing direction. A leading edge of the product is picked-up by a collect cylinder, afterwhich the product travels counterclockwise on the cylinder due to the cylinder's rotation. In the nip between the collect cylinder and a jaw cylinder, a midpoint of the product is picked-up by the jaw cylinder, thus producing a fold. The product is then transferred to the jaw cylinder travelling clockwise. During transfer from the collect cylinder to the jaw cylinder, the transfer point sees counterclockwise motion from the product on the collect cylinder and clockwise motion from the product on the jaw cylinder. As a result, parts of the product are subject to strong mechanical stresses.

In order to ease the mechanical stress of transferred products, brushes have been developed having gaps between bristle tufts. Further gaps are created at angle changes where brushes butt together. Unfortunately, the end of a transferred product can drop into the gaps between brushes or into the gaps created within the brushes, thus forming dog-ears or otherwise damaging the product. It was found that such brushes did not form a uniform, smooth and continuous product guiding surface.

Attempts to arrange alternatingly staggered brushes did not address the foregoing problem. Rather, such configurations suffered from a non-uniform surface as well, and provided no other advantage.

SUMMARY OF THE INVENTION

In view of the technical problems encountered in the prior art, it is an object of the present invention to provide for a uniform product guiding surface having similar density all across and around the product guiding element.

A further object of the present invention is to maintain the density of the guiding surface upon mounting the guiding surface to a preformed backing in the machine.

A still further object of the present invention is to eliminate gaps between bristle tufts having changing angles between each other.

A still further object of the present invention is to provide a guiding element for products such that no gaps exist in the guiding element when products are wrapped around guiding elements having different radii.

According to exemplary embodiments of the present invention, a folder apparatus is provided which comprises a first cylinder for transporting a product; a folding cylinder rotatably engaged with said first cylinder at a nip; and a product guiding device assigned to a transition area between surfaces of the first cylinder and said folding cylinder, said guiding device having a smoothing element which further includes different sections of product contacting elements angled in different directions across a length of the smoothing element.

In accordance with exemplary embodiments, a uniform, continuous guiding surface is created even in those areas in which the guiding element has different radii. Consequently, the gaps in abutting areas are eliminated, thereby providing for a smooth product transfer without any product damage occurring thereon. By arrangement of multidirectional bristles, the bristle density per area is constant to provide a uniformly distributed bristle density even in those areas in which the backing support has different radii; i.e. a high degree of curvature.

In alternate embodiments, rollers can be used as product contacting elements in place of or in conjunction with bristles either arranged regularly distributed or in tufts abutting each other. The bristles or bristle tufts respectively, can be arranged so as to be multi-directional. For example, product guiding elements can be formed with a first section of bristles which have a leaning angle to the left, whereas in the middle of the guiding element there is a second section having bristles arranged substantially perpendicular with respect to a backing or support. In a third section of the product guiding device, the bristles can be arranged having a leaning angle to the right.

In transition areas defined by a change in radius of the backing support, bristles tufts can be arranged having bristles extending substantially perpendicular to the support as well as bristle tufts having a leaning angle to the left or to the right. The uniform surface of the product guiding element can be maintained by increasing the number of bristle rows in those areas of the backing support which are subject to a high degree of bending. Thus, by including a larger number of bristles on an even (i.e., pre-bent) surface of the backing support, there can be maintained an even bristle distribution in a bent state of the backing support, thereby providing for a continuous, uniform surface.

BRIEF DESCRIPTION OF THE DRAWINGS

The foregoing objects and advantages of the present invention, and a method of operation of the invention, together with additional objects and advantages thereof, will be better understood from the following detailed description of exemplary embodiments when read in connection with the accompanying drawings, in which.

DETAILED DESCRIPTION OF THE PREFERRED EMBODIMENTS

Figure 1:
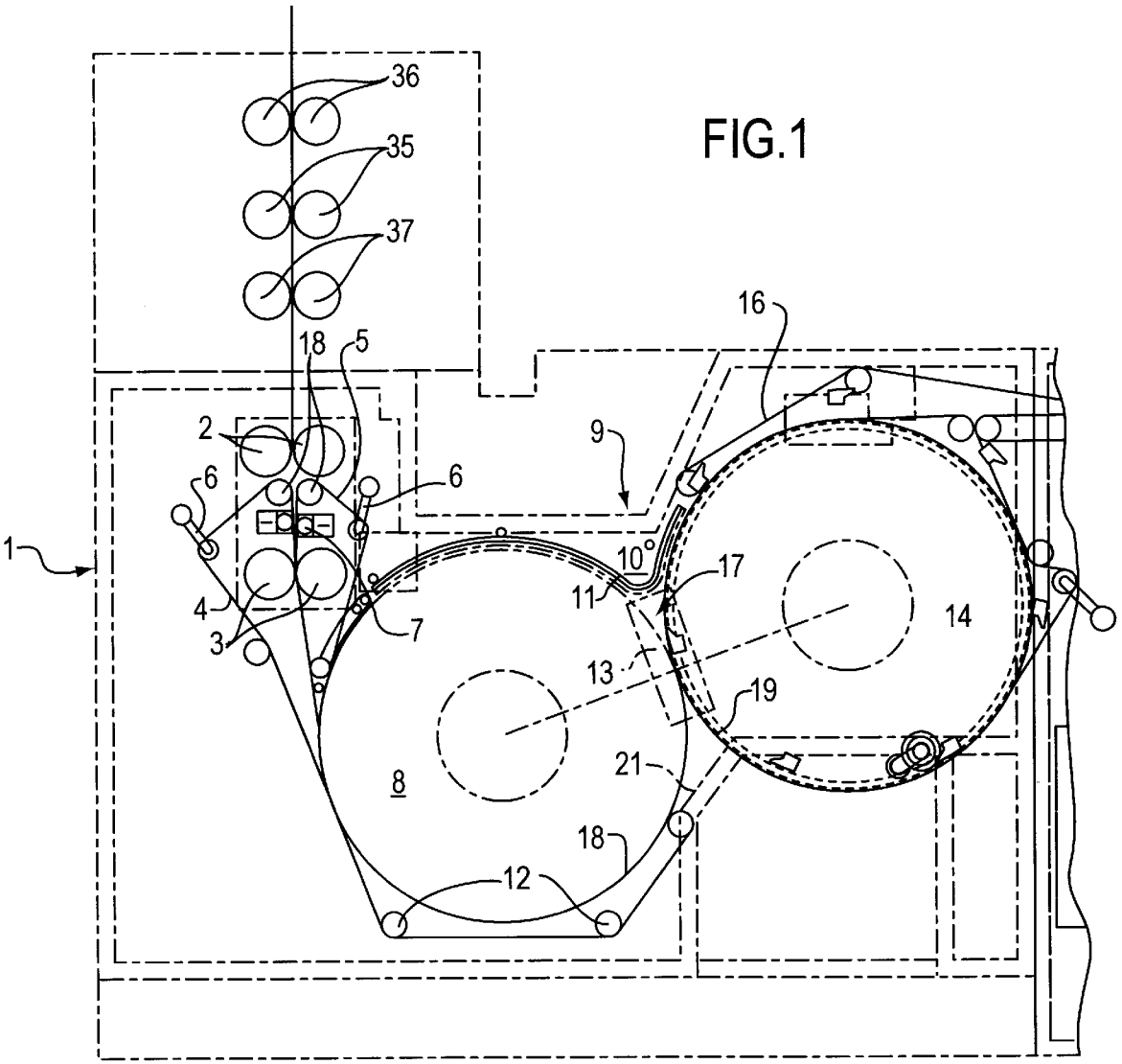
FIG. 1 is a side view of an exemplary folding apparatus which includes folding cylinders in accordance with the present invention.

FIG. 1 shows a general side view of an exemplary embodiment of a folding apparatus according to the present invention, wherein a folding cylinders scheme and a path of a product transporting conveying means within the folder is illustrated.

In a frame of a folding apparatus 1, there is arranged a pair of cutting cylinders 2 comprising a knife and an anvil cylinder. Perforating units represented as cross perforating cylinders 35 can also be included to cross perforate web material before it is severed into products or signatures. The web material is transported by nip rollers 36, through the cross perforating cylinders 35 and through seizing rollers 37 into the cutting cylinders 2.

Below the cutting cylinders 2, a transport system is provided with first and second conveying tapes 4, 5, respectively. Assigned to the conveying tapes 4,5 there are tape tensioning means 6. Integrated into the conveying path of the tapes 4, 5 there is a pair of acceleration rollers, or rolls, 3 and combing rollers 7 which smooth the product as it is transported to the acceleration rollers.

By means of the conveying tapes 4, 5, products are conveyed to a collecting cylinder 8. The products are conveyed in counterclockwise direction to a fold-off area 13 at a nip between the collecting cylinder 8 and a folding, or jaw, cylinder 14.

By means of the belt 4 around the collecting cylinder 8, the products conveyed on a surface 18 of the collecting cylinder 8 are guided through an entering section 21 having each product under positive control. Having reached the fold-off area 13, the products are tucked by tucker blades—which are not shown in detail here—into folding jaws 20 (FIG. 2) arranged on a circumference 19 of the jaw cylinder 14.

A transversal fold is, in an exemplary embodiment, performed at the middle of a product (that is, at a product midpoint), when one half of the length of the product to be transversely folded has reached the circumferential section below a product guiding device 9 having a smoothing element 11. Upon tucking one half of the product into a corresponding jaw 20 of the jaw cylinder 14, an upper half of the product travels in a counterclockwise direction on the collecting cylinder 8 at surface 18 of FIG. 2 while the lower half of the product follows the jaw cylinder 14 in a clockwise direction. The product is pulled by the jaw cylinder to leave the collecting cylinder in a clockwise direction below the smoothing element 11 which extends in a clockwise direction. Within a transfer area 17, the product is subjected to high forces of acceleration, resulting in a whipping effect of the product edges. The guiding device 9, having the smoothing element 11, is affixed to a shield 10 which is mounted within the folding apparatus.

Figure 2:
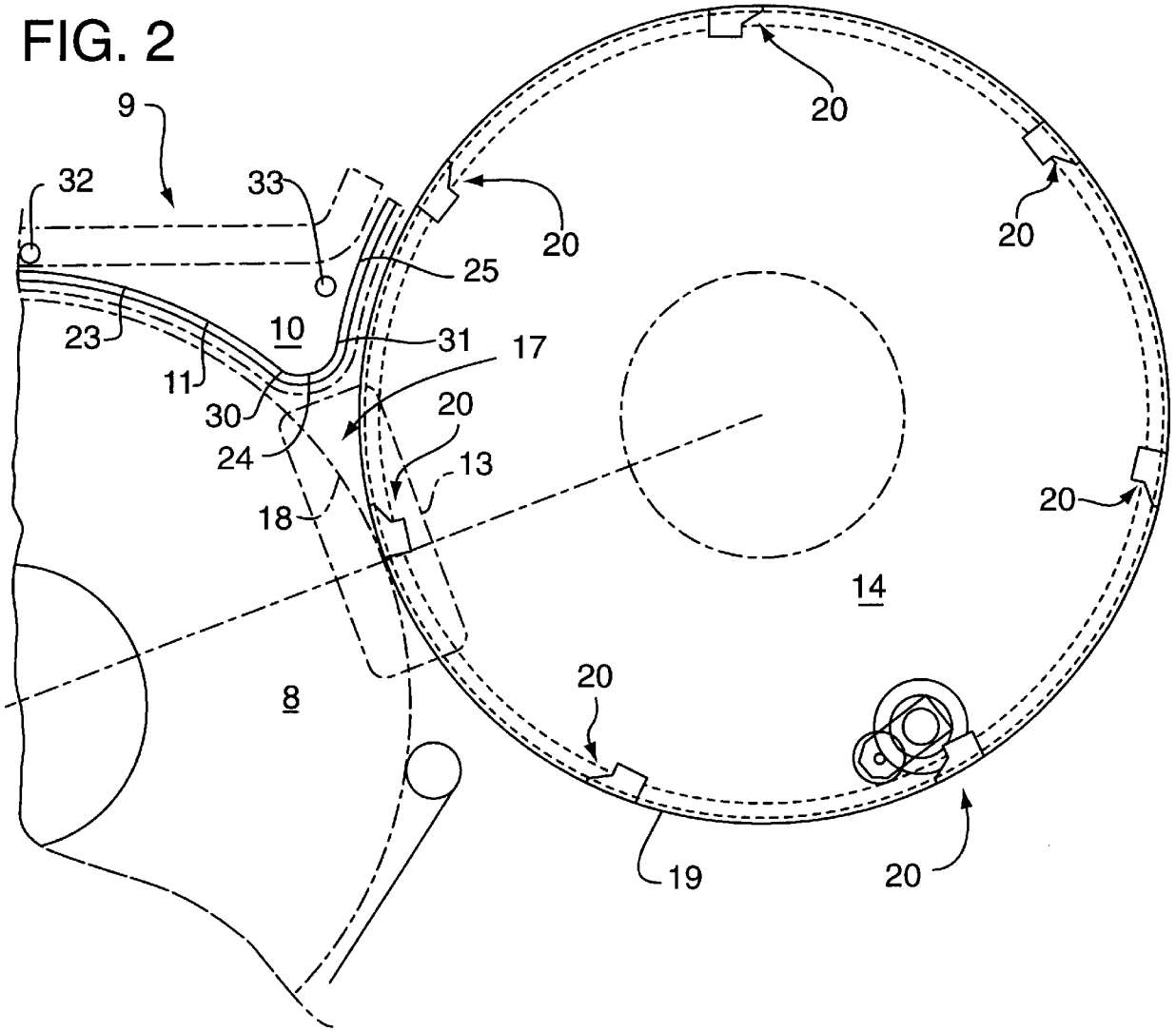
FIG. 2 shows an enlarged view of a product transfer area at the nip between two cooperating cylinders.

The region of the nip between said cooperating collecting and jaw cylinders is shown in greater detail in FIG. 2. In FIG. 2, the fold-off area 13 is shown in a larger scale. Above the fold-off area 13, the product guiding device 9 is shown to have the smoothing element 11 assigned thereto. The smoothing element 11 can be subdivided into three different sections. A first section 23 has a curvature approximately equal to that of the collecting cylinder 8. A second section 24 of the smoothing element 11 has a substantially smaller radius compared to said first section 23. Finally, a third section 25 abuts to the second section 24 of the smoothing element 11. The middle section 24 has, on each side, transition sections 30, 31, respectively, which are further described below.

Figure 3:
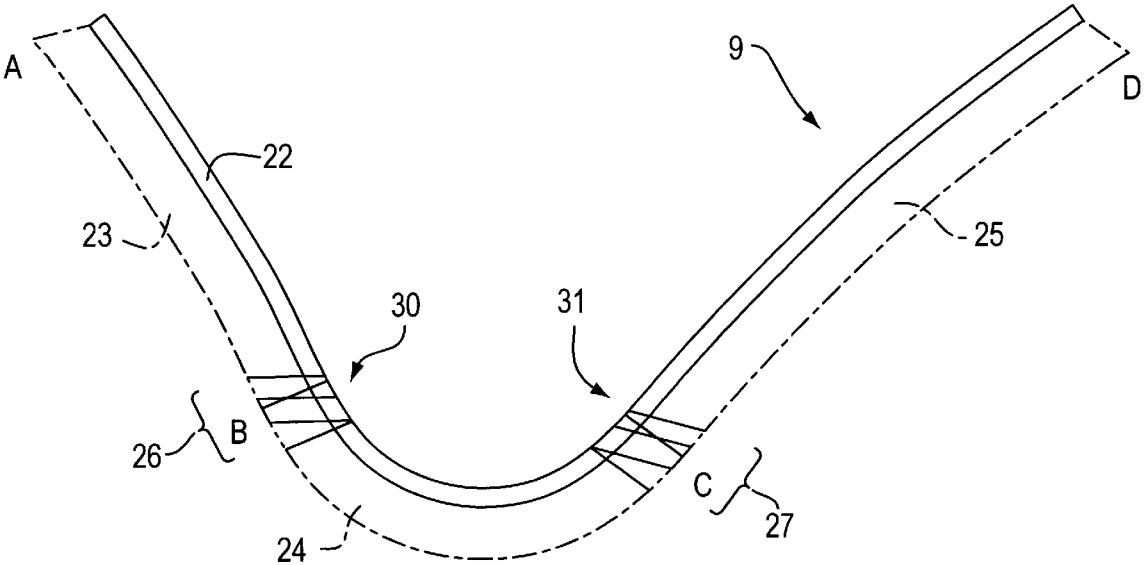
FIG. 3 is a bent refiguration of the guiding device according to an exemplary embodiment of the present invention.
Figure 8:
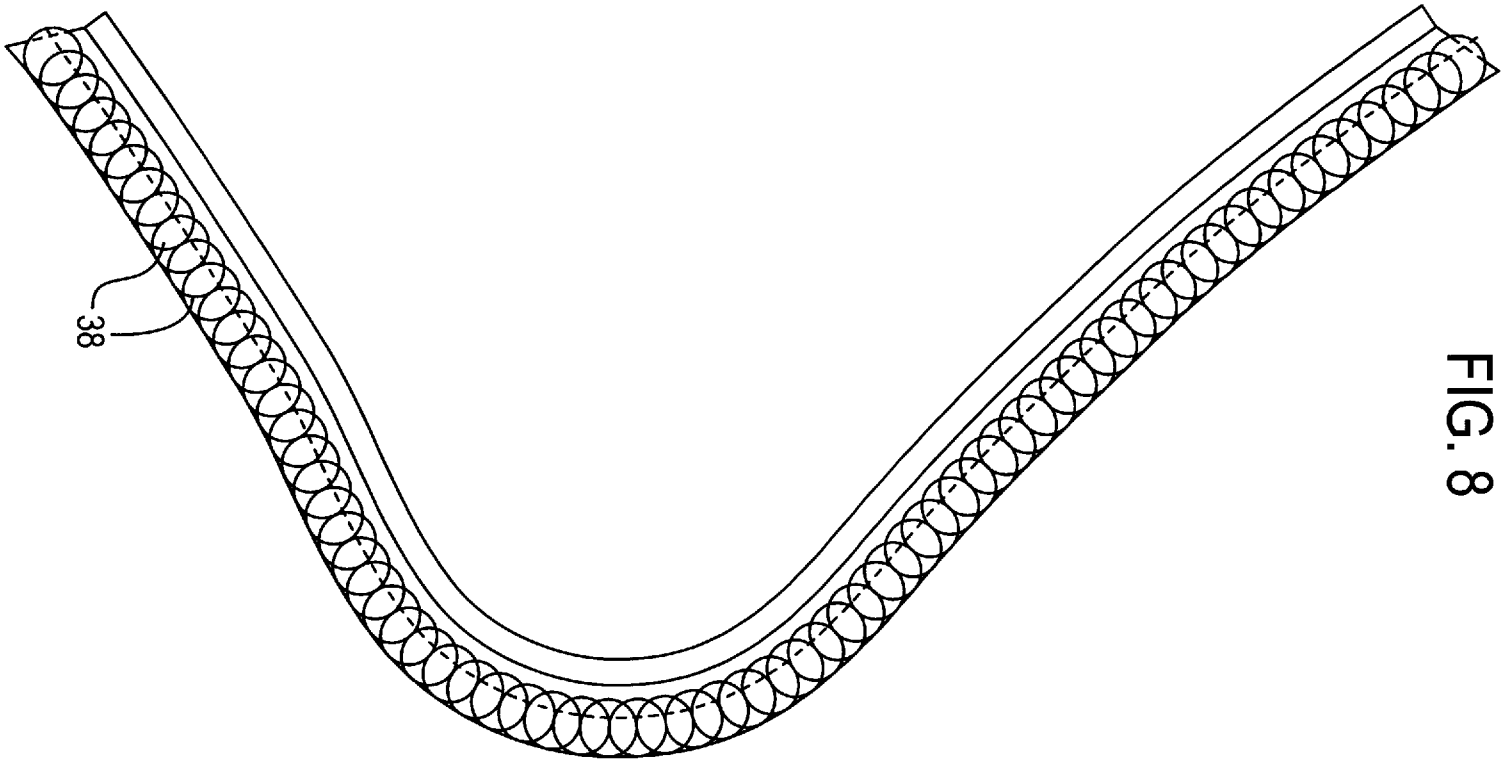
FIG. 8 shows an alternate exemplary embodiment of the present invention.

The product guiding device 9 further includes the shield 10 to which a support or a backing 22, as shown in FIG. 3, is affixed. Product contacting elements, such as bristles or bristle tufts, are mounted on the backing 22, across a length of the smoothing element 11. In an alternate embodiment, the product contacting elements can, for example, be formed as followers. For example, the rows of tufts can be replaced with rows of rollers in an alternate embodiment as shown in FIG. 8. In the exemplary FIG. 8 embodiment, staggered rows of rollers 38, or staggered rows of rollers and brush bristle tufts are used as the product contacting elements. The shield 10 is, in an exemplary embodiment, fixed by means of two mounting axes 32, 33 (FIG. 2) within a frame of the folding apparatus 1.

Figure 4:
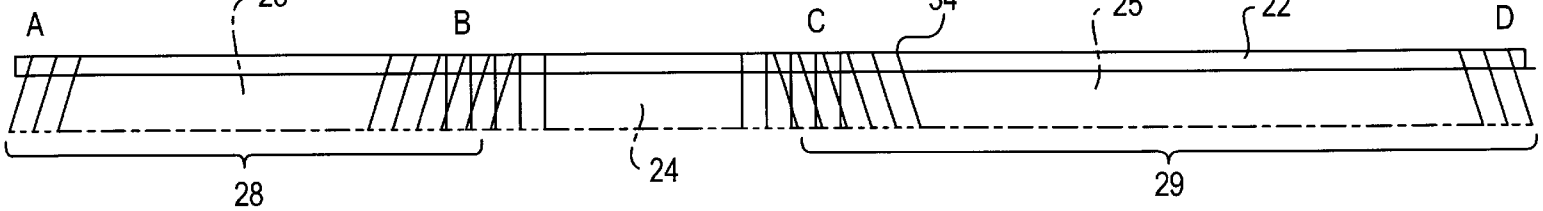
FIG. 4 shows the guiding device of FIG. 3 before being bent.
Figure 5:
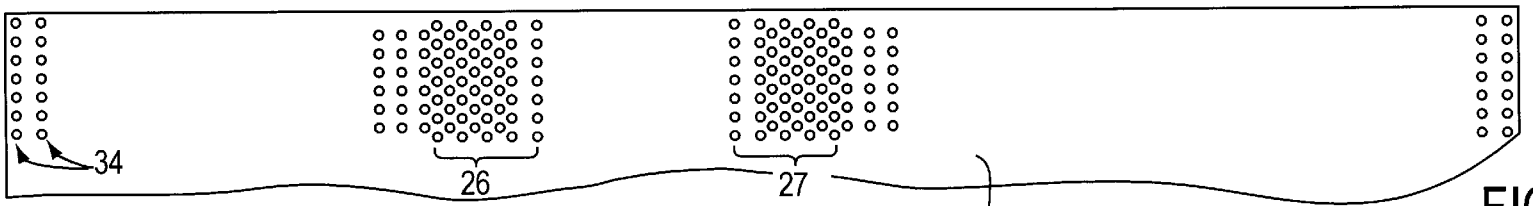
FIG. 5 is a top view of the FIG. 4 guiding device showing areas having tufts of bristles bent into different directions.

In FIGS. 3, 4 and 5, respectively, the product guiding device 9 is shown in a bent side view (FIG. 3), in a state prior to bending (FIG. 4) and finally in a top view (FIG. 5).

FIG. 3 shows the product guiding device 9, the support 22 being bent with different radii. Reference numeral 23 denotes the first section of product contacting elements, such as bristles. The first section extends from A to B as indicated in FIG. 3. The dashed line indicates the surface of the first section 23, wherein the backing support 22 has only a slight radius. Between the first section 23 and the second section 24 there is a transition section 30 extending over the area 26. Within the area 26, straight perpendicular bristles as well as angled bristle tufts are provided so that no gap, (that is, no interruption of a uniform surface of the smoothing element 11) occurs upon bending of the backing or support 22.

In the second section 24, extending from B to C and having a substantially smaller radius than the first section, the bristles are arranged perpendicularly to the backing or support 22. Alternately, angled bristles can be used, as can any combination of perpendicular and angled bristles (such as a gradual transition from perpendicular to angled bristles or vice versa). Within a second transition section 31, extending over the area indicated by reference numeral 27, there are arranged perpendicular, angled and/or any combination of perpendicular as well as angled bristle tufts so as to form a uniform, continuous surface of the smoothing element 11. Abutting to the second section 24 there is arranged a third section 25 extending from C to D, having only a slight curvature.

In FIG. 4, the product guiding device 9 is shown in a pre-bent, even flat state. Within the area indicated by reference numeral 28, the bristles or bristle tufts respectively lean to the left-hand-side whereas in the area indicated by reference numeral 29, the bristles or bristle tufts lean to the right-hand-side. As can be seen below B and C in FIG. 4, rows of bristles 34 are arranged closer to one another. Below areas B and C, there are arranged bristles mounted perpendicularly as well as leaning to one side or to the other side. The areas B and C correspond to the transition sections 30, 31 arranged between the first section 23 and the second section 24, as well as between the second section 24 and the third section 25, respectively.

FIG. 5 shows a top view of the backing or support 22. In the areas indicated by 26 and 27 respectively, which correspond to the transition areas B and C, the number of rows 34 of bristles is significantly higher compared to the ends of the backing 22. Thus, once the backing 22 is bent into a shape such as that shown in FIG. 3, a similar bristle density is provided all across and around the surface of the smoothing element 11. As those skilled in the art will appreciate, each of the bristle locations in FIG. 5 can be configured using any product contacting element, such as a bristle, bristle tuft or roller. For example, as mentioned previously, one row in either the vertical or horizontal direction can be formed with a bristle(s) while the next row in the vertical or horizontal direction can be formed with a roller(s). Alternately, any pattern of different product contacting elements can be used.

It will be appreciated by those skilled in the art that there does not occur a sudden change from perpendicularly arranged bristles or bristle tufts to those bristles or bristle tufts which lean to one side, and vice versa. Rather, any change is a gradual transition within the areas 26, 27 or B and C respectively. An arrangement of the bristles or bristle tufts within the different sections 23, 24 and 25 of the smoothing element 11 in accordance with exemplary embodiments of the present invention provides for a uniform and continuous surface thereof.

The material the bristles are made of is, in accordance with exemplary embodiments, of a certain stiffness so that the products are prevented from whipping upon acceleration. In accordance with exemplary embodiments, the bristle support can be formed of any material, including PVC 90. Bristles can also be formed of any material, including nylon, or nylon in combination with other materials (e.g., 90% nylon and 10% bronze). Exemplary embodiments of the bristle caliper are 0.010 inches nylon and 0.005 inches bronze, with any desired bristle count, including a bristle count on the order of 120 bristles per tuft for a 0.125 inch diameter hole.

In accordance with exemplary embodiments, tuft pull-out can be prevented by twisting the staple upon insertion into the bristle support. For example, bristles can be inserted at an angle of 20° and twisted during insertion to a perpendicular orientation relative to the substrate. Of course, those skilled in the art will appreciate that any other materials or caliper sizes can be used in accordance with exemplary embodiments of the present invention provided such a material can provide sufficient stiffness so that products to be processed are prevented from ripping upon acceleration. Of course, there can also be a mixture of different bristle materials in, or among the different sections 23, 24 and 25 of the smoothing element 11.

The orientation of bristles or bristle tufts leaning to one side (e.g., having a left-hand-side leaning angle as viewed in the exemplary FIG. 4 embodiment) causes a straightening of the respective product half to be accelerated, whereas the bristles or bristle tufts leaning to another side (e.g., having a right-hand-side orientation of bristles within the third section 25 of FIG. 4) supports the guidance of the transferred product on the jaw cylinder 14, since on the jaw cylinder 14 whipping does not occur.

Figure 6:
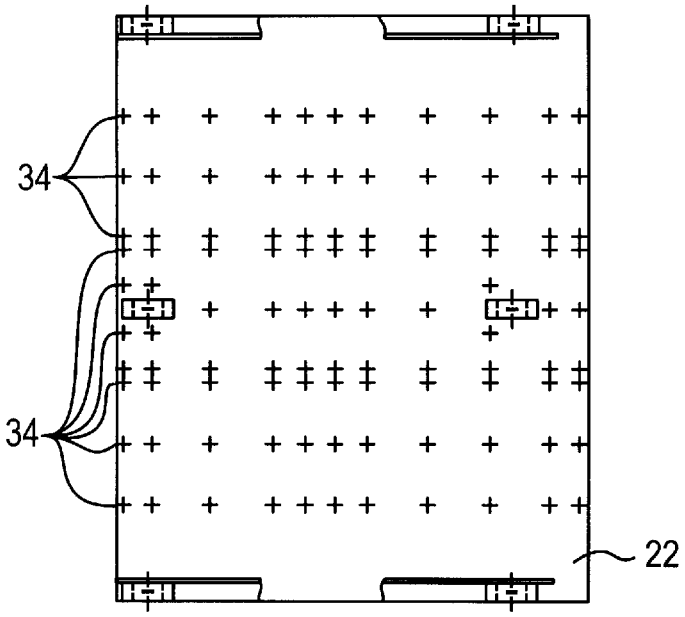
FIG. 6 illustrates an alternate embodiment of a bristle pattern.
Figure 7:
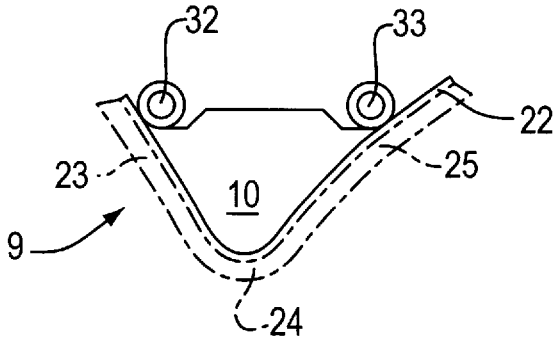
FIG. 7 is a shield to be mounted in the nip between the cooperating cylinders according to an exemplary embodiment of the present invention.

FIGS. 6 and 7 show a schematic top view and side view, respectively, of an alternate embodiment. Generally speaking, in the embodiment of FIGS. 6–7, there are shown rows 34 of bristles or bristle tufts, the number of which increases in a manner as described above, in the transition areas. The bristles or bristle tufts are affixed to a backing support 22 using, for example, mounting screw holes in the support. The number of bristles or bristle tufts can be varied across the width of said backing support 22 as described previously.

In accordance with exemplary embodiments, bristles which are configured to lean to one side or the other for support, can be configured to lean with any angle (e.g., angle of 20° or less or greater). In accordance with exemplary embodiments, bristle height above the support can be on the order of 0.75 inches, or lesser or greater. A support configured to retain the bristles can, as described previously, be formed of any suitable backing material, and can be formed with any dimension suitable for maintaining the bristles in their desired position during operation. In accordance with exemplary embodiments, the thickness of the support can be on the order of 0.276 inches, or lesser or greater. In accordance with exemplary embodiments, adjacent rows of perpendicular bristles can be separated by any desired distance, such as a distance of 0.19 inches, or lesser or greater.

FIG. 7 schematically shows a shield 10 to which a backing or support 22 is affixed. In an upper half of the shield 10, there are provided two mounting axes 32, 33. The product guiding element 9 can include the three sections 23, 24 and 25 described with respect to FIGS. 3–5.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. Folder apparatus comprising:

a first cylinder for transporting a product;

a folding cylinder rotatably engaged with said first cylinder at a nip; and a product guiding device assigned to a transition area between surfaces of said first cylinder and said folding cylinder, said guiding device having a smoothing element which includes different sections of product contacting elements, said product contacting elements being angled in different predetermined directions with respect to a backing element of said smoothing element, across a length of said smoothing element, each of said different sections having a different density of said product contacting elements, said different predetermined directions and said different densities corresponding to different radii of curvature to provide a uniform product guiding surface over said different radii of curvature.

2. Folder apparatus according to claim 1, wherein said product contacting elements are bristles.

3. Folder apparatus according to claim 2, wherein said product contacting elements on said smoothing element in at least one of said different sections are arranged multi-directionally.

4. Folder apparatus according to claim 3, wherein said bristles in a first section of said different sections are arranged with a leaning angle toward one end of said product guiding device.

5. Folder apparatus according to claim 3, wherein said bristles in a second section of said different sections are arranged substantially perpendicular with respect to a bristle support of said product guiding device.

6. Folder apparatus according to claim 3, wherein bristle tufts are arranged in transition sections between a first section and a second section of said different sections, and between said second section and a third section of said different sections, said bristle tufts comprising bristles arranged with a leaning angle relative to a bristle support, and bristles arranged perpendicular relative to said bristle support.

7. Folder apparatus according to claim 6, wherein said transition sections on said support include a number of rows of bristles having a bristle density per inch which exceeds a bristle density per inch in non-transition sections of said bristle support.

8. Folder apparatus according to claim 3, wherein transition areas are provided on said product guiding device which comprise bristle tufts arranged perpendicular to a bristle support.

9. Folder apparatus according to claim 3, wherein transition areas are provided on said product guiding device which comprise bristle tufts with a leaning angle with respect to a bristle support.

10. Folder apparatus according to claim 2, wherein said bristles in a first section of said different sections are arranged with a leaning angle toward one end of said product guiding device.

11. Folder apparatus according to claim 10, wherein said bristles in a second section of said different sections are arranged substantially perpendicular with respect to a bristle support of said product guiding device.

12. Folder apparatus according to claim 11, wherein said bristles in a third section of said different sections are arranged with a leaning angle toward another end of said product guiding device opposite said one end.

13. Folder apparatus according to claim 10, wherein said bristles in a third section of said different sections are arranged with a leaning angle toward another end of said product guiding device opposite said one end.

14. Folder apparatus according to claim 2, wherein said bristles in a second section of said different sections are arranged substantially perpendicular with respect to a bristle support of said product guiding device.

15. Folder apparatus according to claim 2, wherein bristle tufts are arranged in transition sections between a first section and a second section of said different sections, and between said second section and a third section of said different sections, said bristle tufts comprising bristles arranged with a leaning angle relative to a bristle support, and bristles arranged perpendicular relative to said bristle support.

16. Folder apparatus according to claim 15, wherein said transition sections on said support include a number of rows of bristles having a bristle density per inch which exceeds a bristle density per inch in non-transition sections of said bristle support.

17. Folder apparatus according to claim 2, wherein transition areas are provided on said product guiding device which comprise bristle tufts arranged perpendicular to a bristle support.

18. Folder apparatus according to claim 2, wherein transition areas are provided on said product guiding device which comprise bristle tufts with a leaning angle with respect to a bristle support.

19. Folder apparatus according to claim 1, wherein said product contacting elements are rollers.

20. Folder apparatus according to claim 19, wherein said rollers are mounted rotatably.

* * * * *